US010898003B2

(12) United States Patent
Samaraweera

(10) Patent No.: US 10,898,003 B2
(45) Date of Patent: Jan. 26, 2021

(54) FOLDING CUPBOARD STOOL

(71) Applicant: Anura Samaraweera, Colombo (LK)

(72) Inventor: Anura Samaraweera, Colombo (LK)

( * ) Notice: Subject to any disclaimer, the term of this patent is extended or adjusted under 35 U.S.C. 154(b) by 0 days.

(21) Appl. No.: 16/429,653

(22) Filed: Jun. 3, 2019

(65) Prior Publication Data

US 2020/0154898 A1 May 21, 2020

Related U.S. Application Data

(60) Provisional application No. 62/679,141, filed on Jun. 1, 2018.

(51) Int. Cl.
*A47C 12/00* (2006.01)
*A47B 83/00* (2006.01)

(52) U.S. Cl.
CPC ..... *A47C 12/00* (2013.01); *A47B 83/00* (2013.01)

(58) Field of Classification Search
CPC ..... A47C 12/00; A47B 83/00; A47B 3/02; A47B 3/08; A47B 3/087; A47B 3/091; A47B 3/0912
See application file for complete search history.

(56) References Cited

U.S. PATENT DOCUMENTS 76,459 A * 4/1868 Hubbard ..... A47B 3/08 108/132
164,824 A * 6/1875 Fairchild ..... A47B 3/0912 108/131
2,098,826 A * 11/1937 Johanson ..... A47B 3/02 248/188.91
3,030,166 A * 4/1962 Baker ..... A47B 77/10 312/235.1
3,136,386 A * 6/1964 Jung ..... A47B 83/00 182/77
4,135,604 A * 1/1979 Ryan ..... E06C 9/06 182/129
5,085,290 A * 2/1992 Guirlinger ..... E06C 1/005 182/77
5,094,515 A * 3/1992 Low ..... A47B 46/005 182/91
5,131,492 A * 7/1992 Caminiti ..... A47B 46/005 182/156
5,967,255 A * 10/1999 Young ..... A47B 5/06 182/91
6,378,720 B1 * 4/2002 Santa Cruz ..... B65F 1/062 182/91
6,425,457 B1 * 7/2002 Lundry ..... A47B 67/04 182/35
7,815,266 B2 * 10/2010 Sun ..... H05K 7/1488 312/223.1
9,185,970 B1 * 11/2015 Iyewarun ..... A47B 3/08
9,611,691 B1 * 4/2017 Hunter ..... A47B 77/00
9,617,788 B2 * 4/2017 Goodson ..... E06C 1/005
9,883,741 B2 * 2/2018 Demasi ..... A47B 46/005
(Continued)

*Primary Examiner* — Daniel J Rohrhoff
(74) *Attorney, Agent, or Firm* — Kenneth L Green; Averill & Green

(57) ABSTRACT

A folding kitchen stool is stored in a pocket on an inner surface of a kitchen cupboard door. The stool includes left and right folding legs. The right folding legs are widely spaced apart leaving a gap for the left folding legs to overlap the right folding legs when the stool is folded for storing. The pocket provides a mouth which accepts the left folding legs to store the folded stool.

9 Claims, 5 Drawing Sheets

(56) References Cited

U.S. PATENT DOCUMENTS

| | | | | |
|---|---|---|---|---|
| 10,253,565 | B2 * | 4/2019 | Cornthwaite | A47C 12/00 |
| 10,562,174 | B2 * | 2/2020 | Omry | A47B 3/08 |
| 2006/0162627 | A1 * | 7/2006 | Alger | A47B 3/087<br>108/169 |
| 2010/0018442 | A1 * | 1/2010 | Knudsen | A47B 3/08<br>108/176 |
| 2010/0187041 | A1 * | 7/2010 | Crouch | A47C 12/00<br>182/223 |
| 2012/0086317 | A1 * | 4/2012 | Baran | A47B 77/10<br>312/237 |
| 2013/0139737 | A1 * | 6/2013 | Kleinklaus | A47B 3/00<br>108/166 |
| 2015/0090528 | A1 * | 4/2015 | Binegar | E06C 1/005<br>182/12 |
| 2016/0309903 | A1 * | 10/2016 | Huang | A47C 12/00 |

* cited by examiner

FOLDING CUPBOARD STOOL

CROSS-REFERENCE TO RELATED APPLICATIONS

The present application is a Continuation In Part of U.S. patent application Ser. No. 62/679,141 filed Jun. 1, 2018, which application is incorporated in its entirety herein by reference.

BACKGROUND OF THE INVENTION

The present invention relates to accessing kitchen storage, and in particular to a stool to access top shelves of kitchen pantry cupboards, and the like.

The top shelves of kitchen pantry cupboards are the most under-utilized and neglected space in households the world over. Solutions like swiveling shelves; fixed or collapsible step stools; grabbing tools/tongs and even ladders leave much to be desired based on quick accessibility, storage and cost.

BRIEF SUMMARY OF THE INVENTION

The present invention addresses the above and other needs by providing a folding kitchen stool making use of an unrecognized and unused space between the inner surface of a ground level kitchen pantry cupboard door and the cupboard. The folding kitchen stool may be stored in a pocket on the inner surface of the door, or hung behind the cupboard door using a docking bracket in the unused space out of sight, but available when needed and rapidly unfolded. After use, the folding kitchen stool may be returned to the pocket or folded and again hung from the door. The docking bracket may be placed over the top edge of other doors and the folding kitchen stool is hooked on to it until needed anywhere in the house.

In accordance with another aspect of the invention, there is provided a folding stool which is stored in a pocket on an inner surface of a cupboard door. The stool includes left and right folding legs. The right folding legs are widely spaced apart leaving a gap for the left folding legs to overlap the right folding legs when the stool is folded for storing. The pocket provides a mouth which accepts the left folding legs to store the folded stool.

In accordance with another aspect of the invention, there is provided a folding stool stored in a pocket behind a cupboard door of a floor level cupboard, out of sight, but immediately available and easily expanded for use. The stool does not add any strain on hinges of the cupboard door, and can be lifted off the pocket to be used anywhere else or even re-inserted in to another pocket installed on a different cupboard door.

In accordance with another aspect of the invention, there is provided a folding stool which is supported by four folding legs. Being foldable, it is convenient to install complete units under each difficult-to-reach shelf.

In accordance with another aspect of the invention, there is provided a method for storing a folding stool. The method includes: placing a docking bracket on the upper edge of a chosen door, lifting a rear strut up; pushing the rear legs forwards and upwards to rest against the bottom of the top; and folding the front legs down and backwards over the rear legs; lifting the folded stool up by the brace of the two rear legs and hooking on to the docking bracket.

In accordance with still another aspect of the invention, there is provided a method for deploying a folding stool. The method includes: folding the rear legs away from the top; making sure that the rear strut is pushed and locked down below the horizontal level to achieve stability; folding the front legs away from the top; and making the front strut meet the rear strut to provide stability.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Where the terms "about" or "generally" are associated with an element of the invention, it is intended to describe a feature's appearance to the human eye or human perception, and not a precise measurement.

Figure 1:
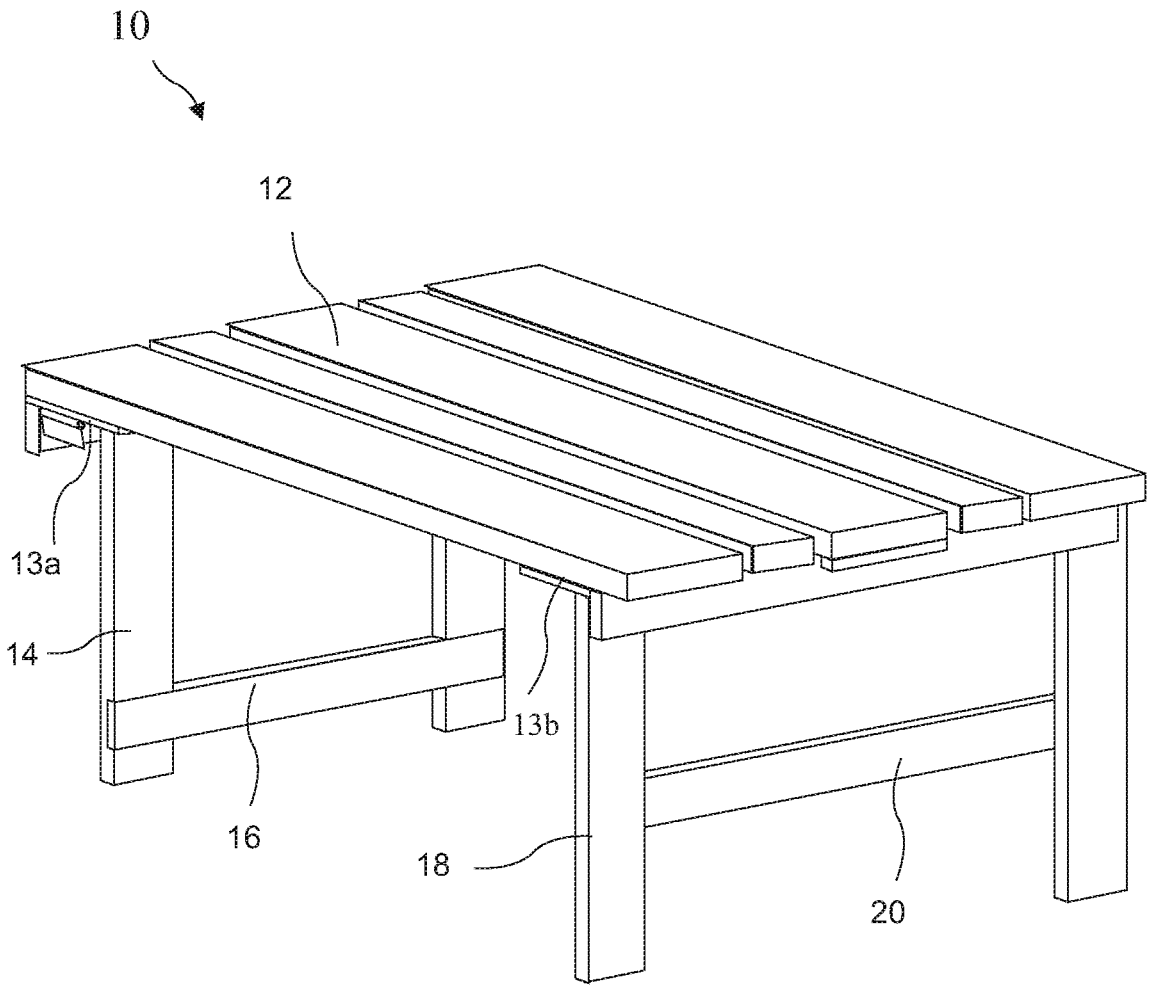
FIG. 1 is a folding stool according to the present invention.
Figure 2D:
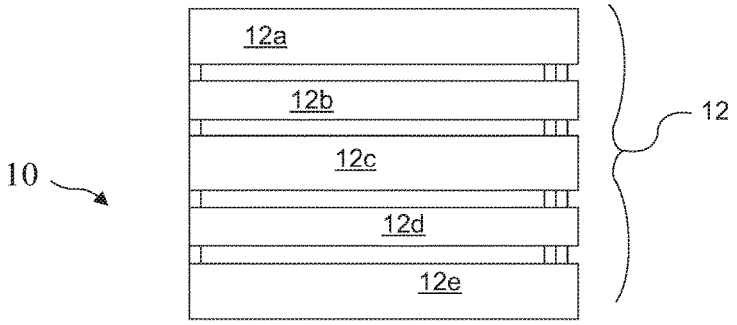
FIG. 2D is a top view of the folding stool according to the present invention.
Figure 2C:
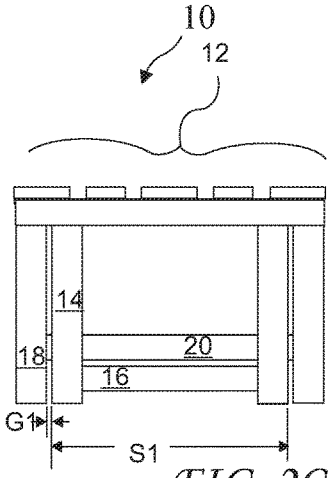
FIG. 2C is a rear view of the folding stool according to the present invention.
Figure 2A:
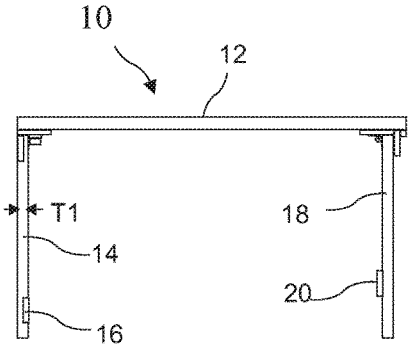
FIG. 2A is a side view of the folding stool according to the present invention.
Figure 2B:
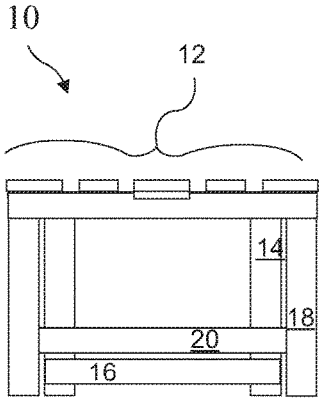
FIG. 2B is a front view of the folding stool according to the present invention.
Figure 2E:
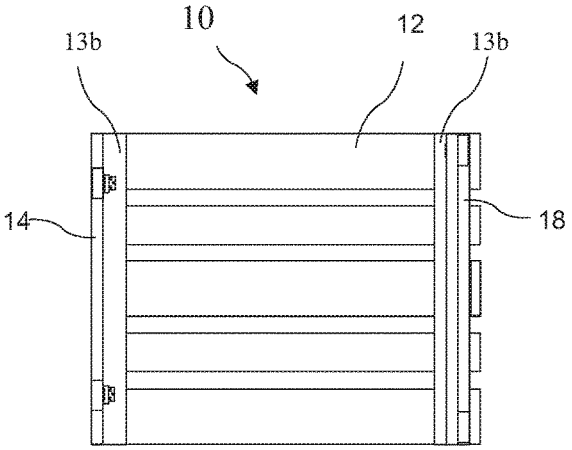
FIG. 2E is a bottom view of the folding stool according to the present invention.

A perspective view of a folding stool 10 according to the present invention is shown in FIG. 1, a side view of the folding stool 10 is shown in FIG. 2A, a front view of the folding stool 10 is shown in FIG. 2B, a rear view of the folding stool 10 is shown in FIG. 2C, a top view of the folding stool 10 is shown in FIG. 2D, and a bottom view of the folding stool 10 is shown in FIG. 2E. The folding stool 10 includes a top 12 which may include 5 planks 12*a*-12*e* and top braces 13*a* and 13*b*. The top 12 is supported by folding rear legs 14 and folding front legs 18. The rear legs include a horizontal brace 16 and the front legs have a horizontal brace 20. The horizontal brace 16 overlaps the rear legs 14 and the horizontal brace 20 is attached to an inside surface of the front legs 18. The rear legs have a thickness T1.

Figure 3A:
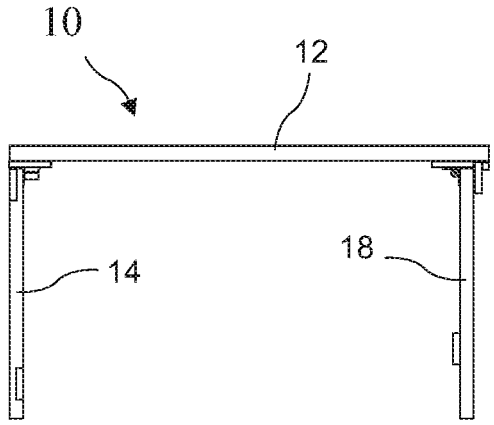
FIG. 3A is a side view of the folding stool according to the present invention before folding.
Figure 3B:
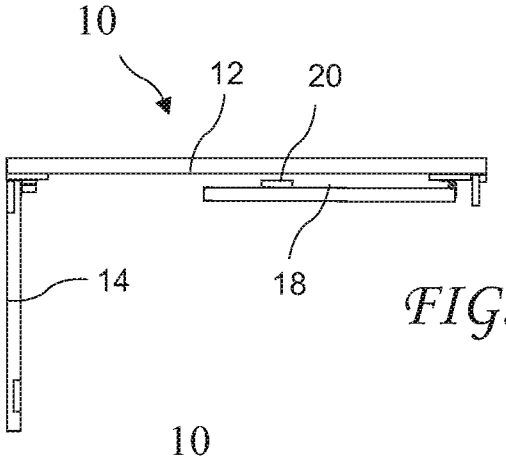
FIG. 3B is a side view of the folding stool according to the present invention with front legs folded against a top.

A side view of the folding stool 10 before folding is shown in FIG. 3A, a side view of the folding stool 10 with front legs 18 folded against the top 12 is shown in FIG. 3B. The horizontal brace 20 rests against the bottom of the top 12 spacing the front legs 18 down from the top 12.

Figure 3C:
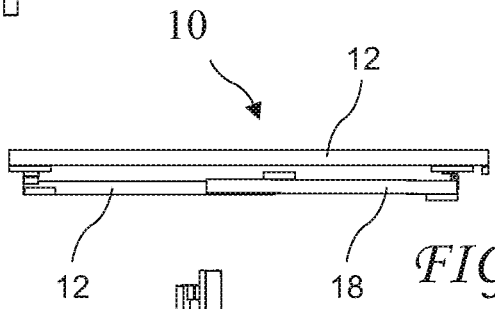
FIG. 3C is a side view of the folding stool according to the present invention with front and rear legs folded against the top.

A side view of the folding stool 10 with front and rear legs 14 folded against the top 12 is shown in FIG. 3C. The folded rear legs 14 overlap the folded front legs 18 and are also spaced down from the top 12.

Figure 3D:
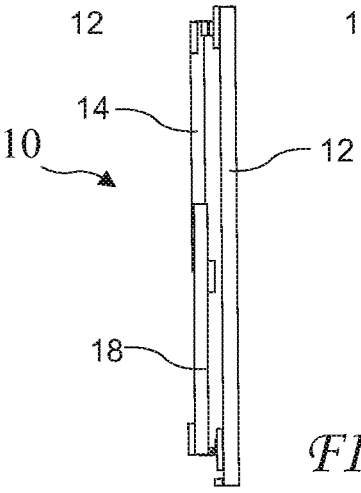
FIG. 3D is a side view of the folding stool according to the present invention with front and rear legs folded against the top and the stool pivoted to a vertical position for storing.

A side view of the folding stool 10 with front legs 14 and rear legs 18 folded against the top 12 and the stool pivoted to a vertical position for storing is shown in FIG. 3D. There is a horizontal gap G between the rear legs 14 and the front legs 18, and the outside sides of the rear legs are spaced apart a spacing S1.

Figure 4:
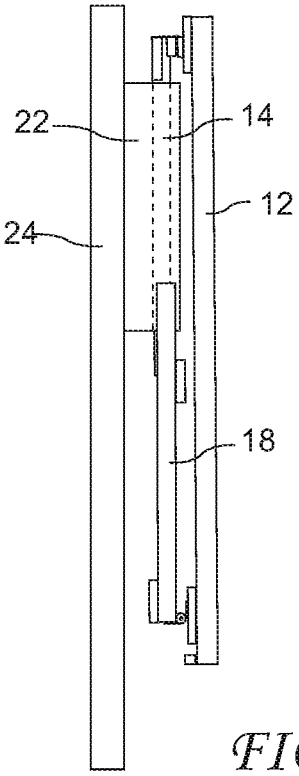
FIG. 4 is a side view of the folding stool according to the present invention with front and rear legs folded against the top and the stool pivoted to a vertical position and stored in a pocket on the back of a cupboard door.
Figure 5:
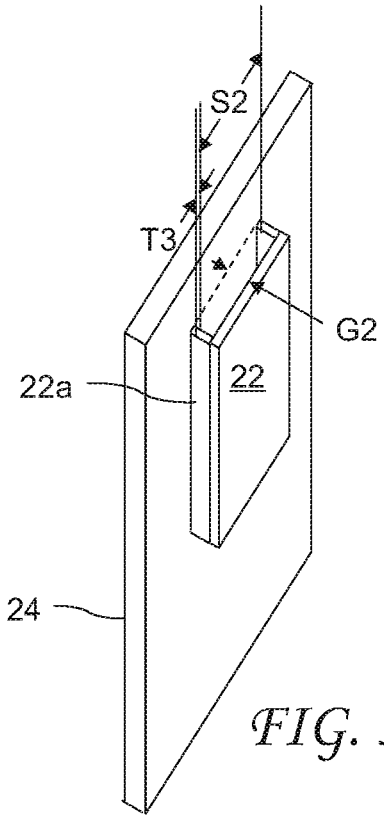
FIG. 5 shows the pocket according to the present invention on the back of the cupboard door.
Figure 6:
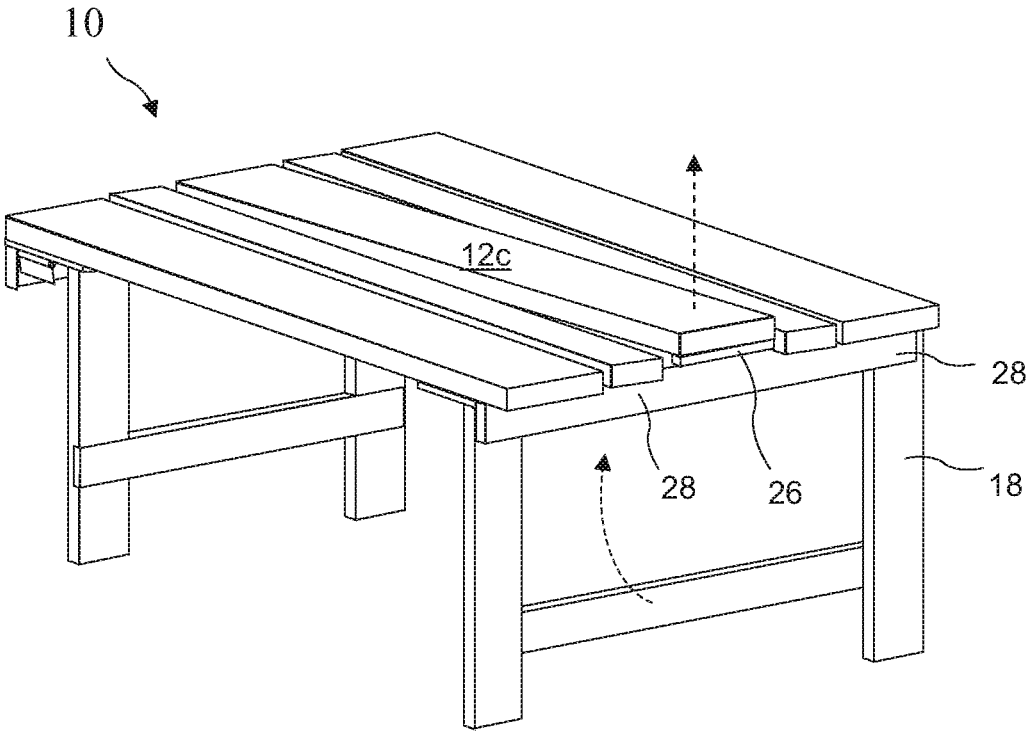
FIG. 6 shows a center plank of a stool top lifted to release the front legs of the folding stool according to the present invention.

A side view of the folding stool 10 with rear legs 14 and front legs 18 folded against the top 12 and the stool 10 pivoted to a vertical position and stored in a pocket 22 on the back of a cupboard door 24 is shown in FIG. 4, and the pocket 22 on the back of the cupboard door 24 is shown in FIG. 5. The pocket 22 has an inside spacing S2 which is greater than the spacing (or width) S1 (see FIG. 2C) and an inside gap G2 which is greater than the thickness T1 of the rear legs (see FIG. 2A) to allow the rear legs to be inserted into the pocket 22. The sides of the pocket have a thickness T3 which is less than that gap G1 (see FIG. 2C) between the inside and rear legs 14 and front legs 18, allowing the legs 14 and 18 to straddle the sides 22*a* of the pocket 22.

A center plank 12*c* of a stool top 12 is attached to the stool near the rear leg s. A stop 26 is attached under forward end of the plank 12*c*. When the front legs 18 are extended away from the top 12, the stop 26 engages a top leg brace 28 of the front legs 18 to retain the front legs 18 in the extended position. A front end of the plank 12*c* may be lifted to separate the stop 26 from the top leg brace 28, to release the front legs 18 to fold against the top 12.

Figure 7:
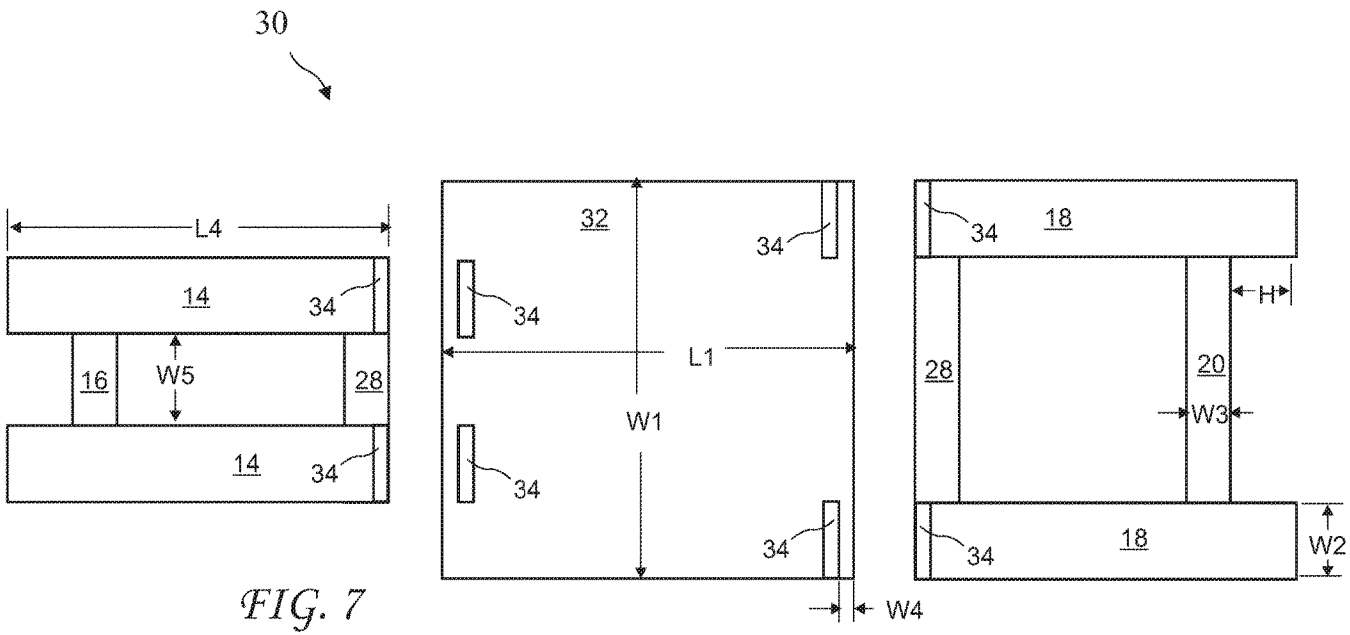
FIG. 7 shows a top and legs of a second embodiment of the folding stool according to the present invention.

A top 32 and legs 14 and 18 of a second embodiment 30 of the folding stool according to the present invention are shown in FIG. 7. The legs 14 and 18 are connected to the top 32 by leg hinges 34. The top 32 has a width W1 of preferably about 260 mm, a length L1 of preferably about 270 mm, and a thickness T7 (see FIG. 8) of preferably about 5 mm. The legs 14 and 18 have widths W2 of preferably about 50 mm and lengths L4 of preferably about 250 mm. The leg hinges 34 are inset from the edges of the top 32 a width W4 of preferably about 10 mm. The braces 16, 20, and 18 have a width W3 of preferably about 30 mm and a thickness T6 (see FIG. 9) of preferably about 5 mm. The braces 16 and 20 are a height H above the bottom of the legs of preferably about 45 mm.

Figure 8:
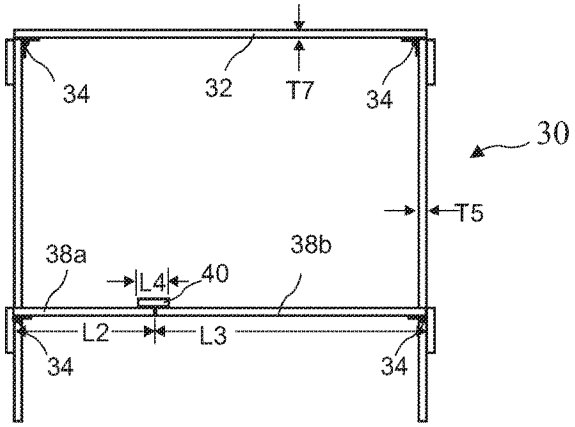
FIG. 8 shows a cross-sectional view of the second embodiment of the folding stool having a strut according to the present invention.

A cross-sectional view of the folding stool 30 having struts 38*a* and 38*b* is shown in FIG. 8. The strut 38*a* has a length L2 of preferably about 80 mm and the strut 38*b* has a length L3 of preferably about 180 mm, or the combined lengths of the struts 38*a* and 38*b* is preferably about equal to the length L1 of the top 32. A stop 40 is fixed to either the strut 38*a* or the strut 38*b*. The stop 40 preferably has a length L4 of about 20 mm.

Figure 9:
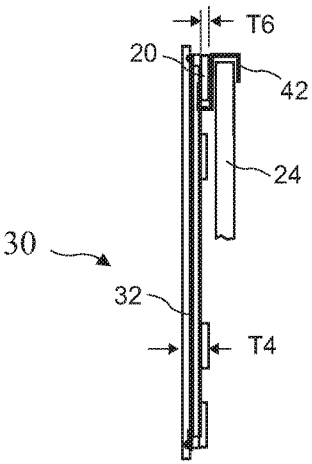
FIG. 9 shows the second embodiment of the folding stool with the legs folded against the top, according to the present invention.
Figure 10:
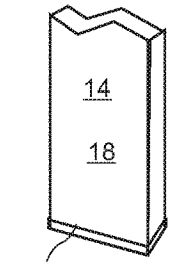
FIG. 10 shows a shoe on a leg of the second embodiment of the folding stool according to the present invention.

The folding stool 30 with the legs 14 and 18 folded against the top 32 is shown in FIG. 9. The folded stool 30 has an overall thickness T4 of preferably less than 18 mm and more preferably 15 mm. An S hook 42 may be hung on a cupboard door 24 and engage a brace 20.

The dimensions are not intended to be exact, and where they are expressed as "about", a dimension within 10% of the stated value is intended to come within the scope of the present invention. The stool is preferably made from a material selected from aluminum alloy, stainless steel, or high density plastic.

The leg 14, 18 of the folding stool 30 is shown with a shoe 44 in FIG. 9.

While the invention herein disclosed has been described by means of specific embodiments and applications thereof, numerous modifications and variations could be made thereto by those skilled in the art without departing from the scope of the invention set forth in the claims.

I claim:

1. A cupboard pocket stool, comprising:

a top;

front legs foldable to reside parallel to the top;

rear legs foldable to reside parallel to the top and overlapping between the front legs;

a first strut hingedly attached to the front legs at a first hinged end and having a first contacting end opposite to the first hinged end;

a second strut hingedly attached to the rear legs at a second hinged end and having a second contacting end opposite to the second hinged end;

the struts folding up against the front legs and the rear legs for storage;

the struts foldable down to position the first contacting end touching the second contacting end to maintain separation of the legs; and the stool storable behind a cupboard door without holding the cupboard open; and a pocket configured to attach to a back of a cupboard door, the pocket comprising:

two sides and a back;

an inside gap between the cupboard door and the back greater than the thickness of the rear legs;

the sides having an inside spacing greater than the width of the rear legs; and the rear legs insertable into the gap while the front legs reside outside the sides of the pocket.

2. The stool of claim 1, wherein the width of the rear legs is less than a gap between the front legs.

3. The stool of claim 1, wherein:

braces are attached to outside surfaces of the legs; and the total combined thickness of the top, legs, and braces, is less than 18 mm.

4. The stool of claim 1, wherein:

braces are attached to outside surfaces of the legs; and the total combined thickness of the top, legs, and braces, is about 15 mm.

5. The stool of claim 1, wherein:

braces are attached to outside surfaces of the legs; and the thickness of the top, the legs, and the braces is about 5 mm.

6. The stool of claim 1, wherein the front and rear legs are hingedly attached to the top; and the front and rear legs fold away from the top about 90 degree where top ends of the legs butt against the top to prevent additional folding.

7. The stool of claim 1, further including an S hook, attachable onto a cupboard door and configured to engage a top brace of the stool.

8. The stool of claim 1, further including a strut stop attached to one of the first strut or the second strut and overlapping both the first contacting end and the second contacting end when the first strut and the second strut are folded down to maintain separation of the legs.

9. The stool of claim 1, wherein the first strut and the second strut are single piece struts.

* * * * *